United States Patent [19]

Charlton

[11] Patent Number: 4,557,121

[45] Date of Patent: Dec. 10, 1985

[54] ELECTRIC FAIL-SECURE/FAIL-OPEN LOCK MECHANISM

[75] Inventor: Newton W. Charlton, Thousand Oaks, Calif.

[73] Assignee: Security Engineering, Inc., Forestville, Conn.

[21] Appl. No.: 524,907

[22] Filed: Aug. 22, 1983

[51] Int. Cl.[4] ..... E05B 47/00

[52] U.S. Cl. ..... 70/279; 70/129

[58] Field of Search ..... 70/279, 280, 281, 282, 70/277, 129; 292/144

[56] References Cited

U.S. PATENT DOCUMENTS

| | | | |
|---|---|---|---|
| 2,763,888 | 9/1956 | Billeter | 292/144 |
| 2,786,701 | 3/1957 | Povlich | 292/144 |
| 3,893,723 | 7/1975 | Boule | 70/279 |
| 4,099,752 | 7/1978 | Geringer | 292/144 |
| 4,372,419 | 2/1983 | Barnett | 70/279 |

*Primary Examiner*—Robert L. Wolfe

*Attorney, Agent, or Firm*—Prutzman, Kalb, Chilton & Alix

[57] ABSTRACT

An electric door lock is disclosed comprising an elongated housing for mounting in a door or frame member, a bolt slidably mounted in the housing for movement between a first position and a second position with the first position being a projected locking position and the second position being a retracted nonlocking position, a spring for normally urging the bolt towards one of the first and second positions, a solenoid for electrically actuating the bolt to the other of the first and second positions with the solenoid having a plunger element moveable from a first position to a second position, a connector assembly for connecting the plunger element to the bolt to move the bolt to the other of the first and second positions by movement of the plunger element to the second position, and a manually operative rotative assembly for mechanically moving the plunger element to the second position. Also disclosed is an automatically deadlatching door lock having a crank lever with first and second retaining surfaces to engage a locking bolt for deadlatching against an external driving force.

23 Claims, 9 Drawing Figures

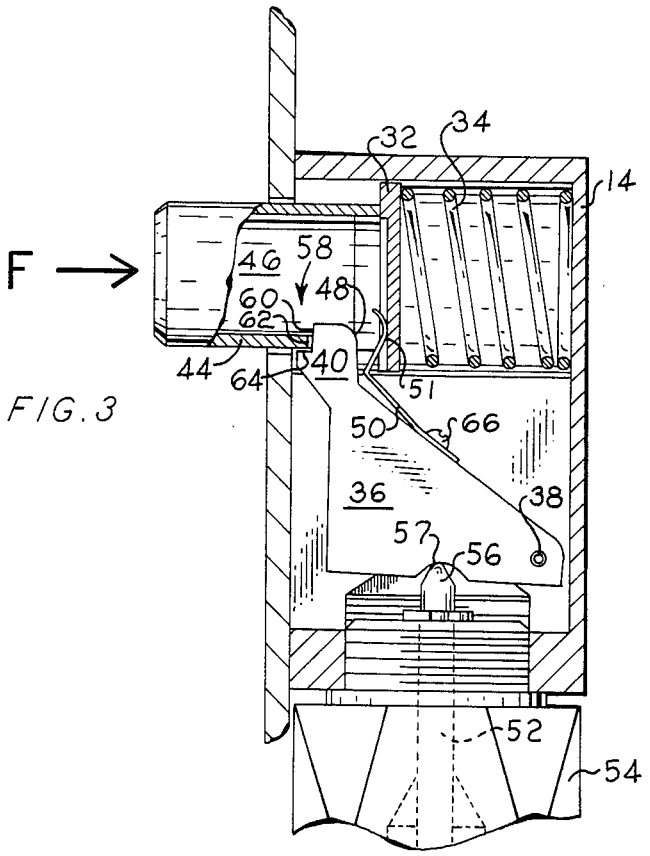
FIG. 3
FIG. 4
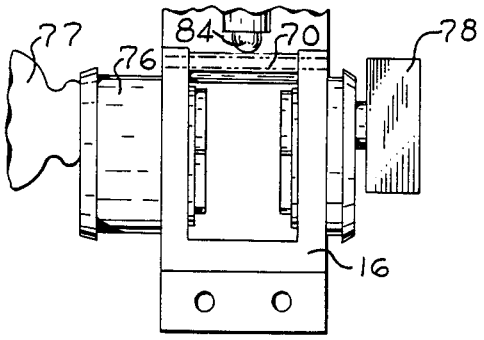

ELECTRIC FAIL-SECURE/FAIL-OPEN LOCK MECHANISM

BACKGROUND OF THE INVENTION

This invention relates to lock mechanisms and more particularly to mechanisms which are electrically actuated.

In high security areas such as banks, computer rooms, museums, etc., electrically actuated door locks of either the fail-secure or fail-open type are employed. For such applications, it is often preferable that the lock mechanism be mounted in a conventional narrow door stile or frame member and, therefore, it is necessary that the lock mechanism be relatively narrow, shallow, and compact.

In a fail-secure electric door lock of this type, it is desirable to provide automatic deadlatching on electrical failure and a manual mechanical release. In a fail-open electric door lock, it is similarly desirable to provide normal electrical deadlatching, automatic unlatching on electrical failure and manual mechanical override to deadlatch the door.

A fail-secure electric door lock mechanism is disclosed herein providing automatic deadlocking of the bolt upon de-energization of the lock mechanism and manual mechanical withdrawal of the bolt from the locked condition in the event of power failure. Also disclosed is a fail-open electric door lock mechanism providing manual mechanical and electrically actuated deadlatching.

It is a principal object of this invention to provide a new and improved electrically operated door lock mechanism.

It is a further object of the invention to provide a fail-secure electric door lock having a manual mechanical release.

A further object of the invention is to provide an automatic deadbolt assembly that can be employed with a fail-secure electric door lock.

A still further object of the invention is to provide a fail-open electric door lock having an electrically operated deadlatch and a mechanical override.

Yet another object of the invention is to provide an electric door lock mechanism that is economical to manufacture, durable in use, and reliable in operation.

Other objects will be in part obvious and in part pointed out in more detail hereinafter.

The invention accordingly consists in the features of construction, combination of elements and arrangement of parts which will be exemplified in the construction hereafter set forth and the scope of the application of which will be indicated in the appended claims.

BRIEF DESCRIPTION OF THE DRAWINGS

FIG. 3 is an enlarged view, partly broken away, of the door lock mechanism showing automatic deadlatch assembly thereof with its bolt slightly retracted from its position shown in FIG. 1.

FIG. 4 is a partial rear view, partly broken away, of the lower end of the lock mechanism of FIG. 1 and showing a manually operated rotary lock subassembly thereof.

DESCRIPTION OF THE PREFERRED EMBODIMENT

Figure 1:
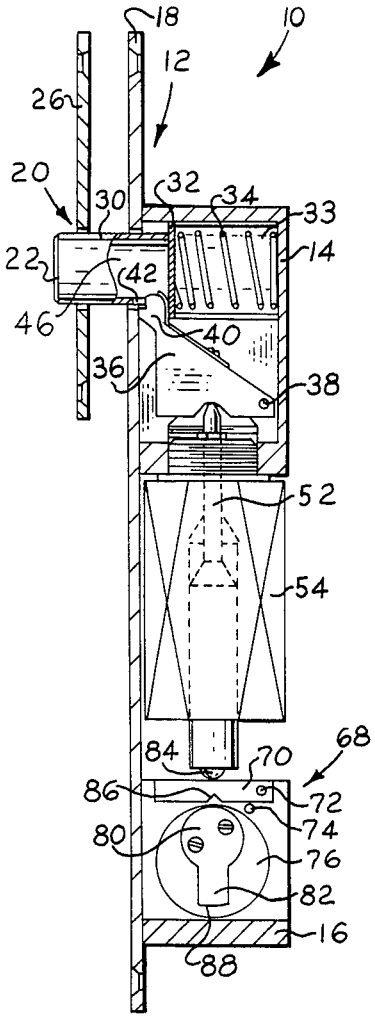
FIG. 1 is a side sectional view of a fail-secure electric door lock mechanism incorporating an embodiment of this invention showing the lock mechanism in a locked condition.

Referring to the drawings wherein like numerals are used thoughout to designate the same or like parts, a "fail-secure" electric door lock mechanism of this invention is shown in FIG. 1 and generally designated by the numeral 10.

The door lock 10 includes an elongated housing assembly 12 having an upper support housing 14, a lower support housing 16, and a lockfront or plate 18. The housing assembly 12 is dimensioned and configured for mounting in a conventional narrow door stile or frame member wherein the depth limitation is significant.

Figure 2:
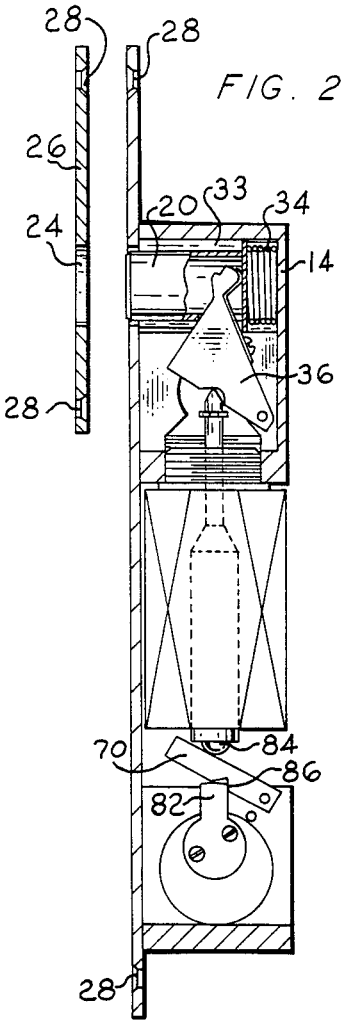
FIG. 2 is view similar to FIG. 1 showing the door lock mechanism in an unlocked condition.

A bolt 20 is slideably mounted in the upper housing 14 for movement between a projected locking position as shown in FIG. 1 and a retracted non-locking position as shown in FIG. 2. In the projected locking position, the outer end 22 of the bolt 20 extends through an aperture 24 in the strike plate 26 mounted on door (not shown) adjacent lockfront 18. Strike plate 26 and lockfront 18 contain a number of screw apertures for securement to the door and frame member.

The bolt 20 has a generally tubular body or shank portion 30 extending between the outer end 22 and a flanged inner end 32. The flanged end 32 rides within a cylindrical recess 33 in the upper housing 14 and a compression spring 34 mounted within the recess 33 engages the upper housing 14 and the flanged end 32 to normally urge the bolt 20 toward the projected locking position as shown in FIGS. 1 and 3.

The bolt 20 is moved inwardly by the pivotal movement of a bellcrank lever 36. The lever 36 is pivotally mounted at its lower end to the upper housing 14 by a pivot pin 38. The upper end 40 of the lever 36 has a rounded edge 48 and extends through a longitudinally extending slot 42 in the wall 44 of bolt 20. Being of tubular configuration, wall 44 forms an interior chamber 46 and the upper end 40 extends through slot 42 into chamber 46 to rest against the interior surface of the flanged end 32 of the bolt 20. A flat spring 50 is mounted to the lever 36 and has a curved end portion 51 disposed between the rounded edge 48 and the flanged end 32.

The lever 36 is pivotable about the pivot pin 38 between a rest position as shown in FIG. 1 to an operating position as shown in FIG. 2. Upon pivotable movement of lever 36 from the rest position to the operating position, the rounded edge 48 pushes on the flanged end 32 against the tension of spring 34 to slide the bolt 20 to the retracted non-locking position. Thus, the pivotal movement of the lever 36 from the first position to the second position operates to retract the bolt 20.

The lever 36 is pivotally displaced by the vertical movement of the plunger 52 of the solenoid 54. The plunger 52 has a push rod 56 at its upper end engaging a recess 57 in the lower surface of the lever 36. The plunger 52 is electrically actuated from a normal retracted position within the solenoid 54 as shown in FIG. 1 to an extended position as shown in FIG. 2. The plunger 52 is slidably mounted within the solenoid 54 to allow mechanically actuated movement of the plunger 52 from the retracted position to the extended position. Therefore, the plunger 52 may also be mechanically extended to attain a manual retraction of bolt 20.

Referring to FIG. 3, the end portion 40 of the lever 36 is configured to form an automatic deadlatch means generally designated by the numeral 58 and comprising a first retaining surface 60 facing the outwardly disposed lateral edge 62 of the slot 42 and a second retaining surface 64 below the bolt 20. The retaining surfaces 60 and 64 are generally orthogonal and form a notch in the upper end 40 of the lever 36.

In the projected locking position of FIG. 1, the lateral edge 62 of the slot 42 is adjacent and slightly spaced apart from the first retaining surface 60. Turning to FIG. 3, an external driving force "F" is shown acting upon bolt 20 toward its retractive non-locking position. Such an external force, as would occur if there is an attempt to force open the lock, will move the bolt 20 inwardly so that edge 62 engages the first retaining surface 60. The spring 50 is connected by a threaded fastener 66 to lever 36 and engages the inner end 32 of the bolt 20 to bias or urge the upper end 40 of the lever 36 towards the lateral edge 62. The spring 50 provides sufficient biasing force to insure that the retaining surface 60 remains in position to engage the lateral edge 62 an does not pivot upwardly through the slot 42 as a result of the external driving force.

The contact of the lateral edge 62 with the first retaining surface 60 will cause upward pivotal movement of the lever 36 about the pivot pin 38. This pivotal movement will cause the second retaining surface 64 to engage the outer surface of wall 44 thereby preventing further upward pivotal movement of lever 36. Since the engagement of the second retaining surface 64 with the wall 44 prevents further pivotal movement of the lever 36, the first retaining surface 60 is thus rigidly fixed in position to stop any further inward movement of the bolt 20 towards the retracted non-locking position. Accordingly, the interaction of the retaining surfaces 60 and 64 with the bolt 20 deadlatches the bolt 20 against any external driving force.

The deadlatching operation of the deadlatch assembly 58 is automatic. During the normal retraction of the bolt 20 by pivotal movement of the lever 36, the second retaining surface 64 pivots upwardly through the slot 42 and avoids contacting the wall 44 and the lateral edge 62 because there is sufficient clearance between the lateral edge 62 and the first retaining surface 60. During an abnormal external force acting upon the bolt 20, the first retaining surface 60 is held in position by the spring 50 to abut the lateral edge 62 and initiate the deadlatching action.

The automatic deadlatching feature of the crank lever 36 is not restricted to an electric lock but may be benefically utilized in various mechanical locks as it provides a compact, reliable, and economical mechanism for retracting and automatic deadlatching a bolt. Thus, the crank lever 36 provides a dual function, namely to retract the bolt upon pivotal movement and to deadlatch the bolt against forced retraction.

Returning to FIG. 1, a manually operative rotative assembly for mechanically moving the plunger 52 to its extended position is generally designated by the numeral 68 and is shown mounted to the lower housing 16. The assembly 68 functions to mechanically retract the bolt 20 from the locked position in the event of power failure or electrical failure of the solenoid 54 and includes a lever arm or movable plate 70 which pivots about a pivot pin 72 and is limited in downward movement by a stop pin 74. A manually rotative key cylinder 76 and a manually rotative thumb turn 78 with attached cams 80 are mounted to the housing 16 below the plate 70. The cam 80 has a radially extending cam arm 82 whereby manual rotation of the key 77 or the thumb turn 78 will rotate the cam arm 82 into engagement with the lower surface of the plate 70 to pivot the plate 70 upwardly. As shown in FIG. 2, the pivoted plate 70 engages the lower end 84 of the plunger element 52 to displace the plunger 52 upwardly. The plunger 52 in turn pivots the lever 36 to retract the bolt 20.

The lower surface of the plate 70 has a "V" shaped cutout or notch 86 to interlockingly engage the outer end 88 of the cam arm 82. The notch 86 acts as a limit on the rotation of the cam 80 and latches the cam 80 in the upright position (shown in FIG. 2) due to the force applied by the compression spring 34 through the lever 36, the push rod 56 and the plunger 52. In this latched condition, the bolt 20 is held in the fully retracted unlocked position. With the lock in this latched position, rotation of either the thumb turn 78 or the key 77 in the reverse direction will disengage the cam arm 82 from the notch 86 and all the components will assume the locked position of FIG. 1 through the force of the compression spring 34.

In operation, electrical actuation of the solenoid 54 by a switch (not shown) will extend the plunger arm 52 upwardly to pivot the crank lever 36 to retract the bolt 20 to the unlocked position of FIG. 2. The lock 10 is "fail-secure" in that the lock will return to the locked position upon a de-energizing of the solenoid 54 because of a loss of electrial power. In the event of an interruption of electricity to the solenoid 54, the compression spring 34 moves the bolt 20 to the locking position and returns all the other components to the "rest" position of FIG. 1.

In the projected locking position, the bolt 20 is automatically deadlatched by the interaction of the deadlatch assembly 58 of the lever 36 with the bolt 20. A manual mechanical release of the bolt 20 is also provided that allows the bolt to be retracted and maintained in the unlocked position of FIG. 2 irrespective of de-energization of the solenoid.

Figure 5:
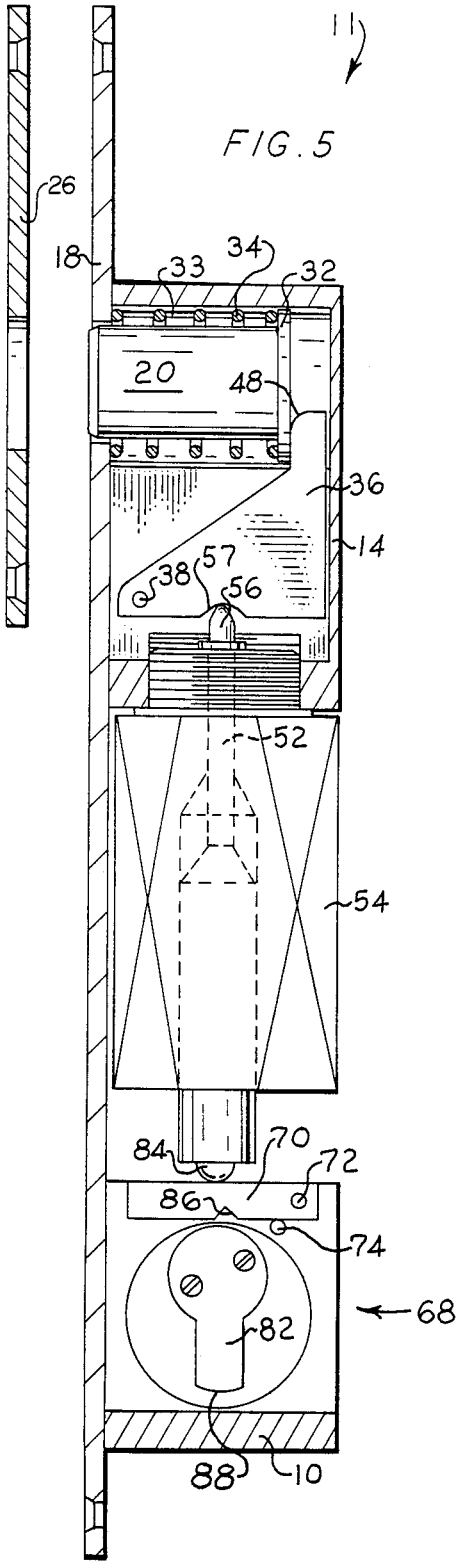
FIG. 5 is a side sectional view of a fail-open electric door lock mechanism incorporating a second embodiment of this invention, and showing the lock mechanism in an unlocked condition.

Turning to FIG. 5, a "fail-open" electric door lock mechanism of this invention is generally designated by the numeral 11. In this configuration, the compression spring 34 is mounted about the bolt 20 between the front plate 18 and the flanged inner end 32 to urge the bolt 20 toward the retracted non-locking position. A bellcrank lever 36 is pivotally mounted at its lower end to the upper housing 14 by a pivot pin 38. The upper end 40 of the lever 36 has a rounded pusher edge 48 which engages the outer surface of the flanged end 32 of the bolt 20. Upon pivotal movement of the lever 36 from the rest position of FIG. 5 to the operating position of FIG. 6, the rounded edge 48 pushes upon the flanged end 32 to slide the bolt 20 against the tension of the spring 34 to the locked position of FIG. 6.

Figure 6:
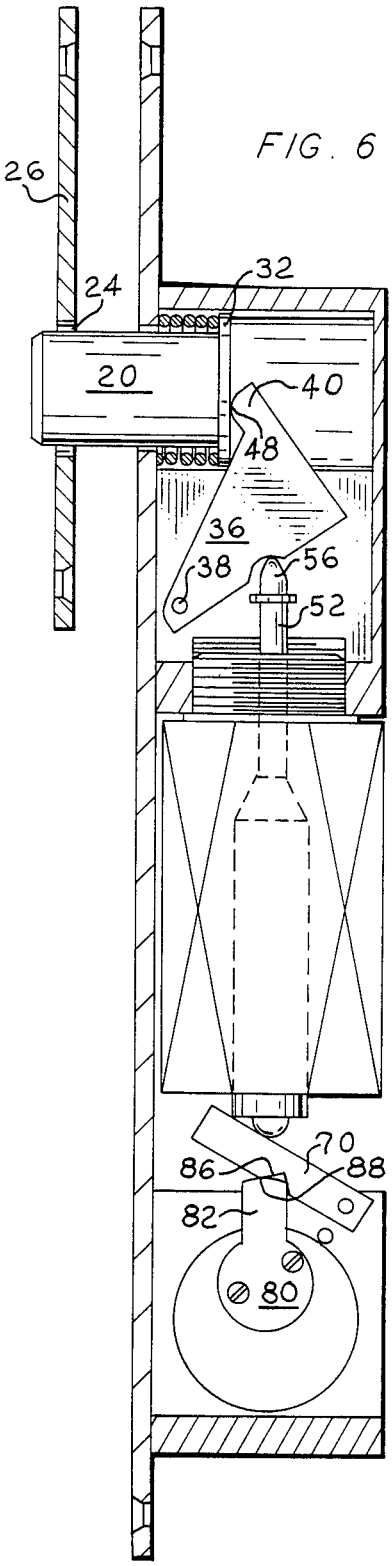
FIG. 6 is a view similar to FIG. 5, showing the door lock mechanism in a locked condition.

The upward extension of the plunger 52 of the solenoid 54 pivots the lever 36 to project the bolt 20 into the locked position of FIG. 6 wherein the bolt 20 extends into the aperture 24 of the strike plate 26.

Similar to the embodiment of FIG. 1, the plunger 52 is electrically actuated from a normally retracted position within the solenoid 54 as shown in FIG. 5 to an extended position as shown in FIG. 6 by the energizing of the solenoid 54. The plunger 52 may also be mechanically extended by the manually operative rotative assembly 68 to attain a manual projection of the bolt 20.

Upon manual projection of the bolt 20, the bolt 20 is also automatically deadlatched in a locked position. That is, rotation of the cam arm 82 is latched by the notch 86 interlockingly engaging the outer end 88 of the cam arm 82 as shown in FIG. 6. Because of the direct contact between the bolt 20, the lever 36, the push rod 56, and the plunger 52, any inward movement of the bolt 20 is prevented by the locked condition of the plunger 52 due to the plate 70 and the cam 80. The bolt 20 is thereby deadlatched to resist any external driving of the bolt towards the retracted unlocked position.

Deadlatching can also be selectively attained by the manual rotation of the cam 80 after projection of the bolt 20 by electrical actuation of solenoid 54.

Figure 8:
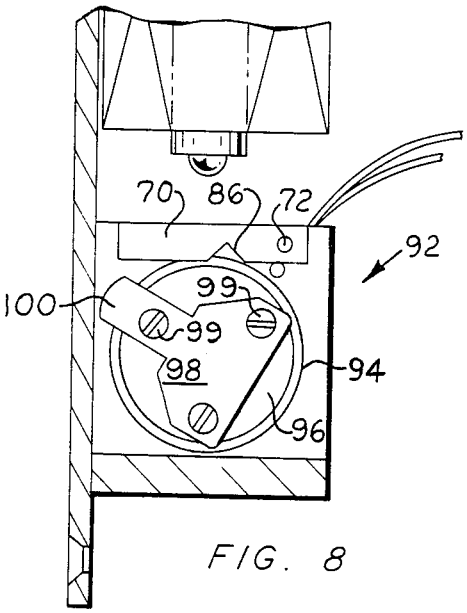
FIG. 8 is a partial side sectional view taken generally along line 8—8 of FIG. 7, showing the electric deadlatch assembly in a de-energized position.
Figure 9:
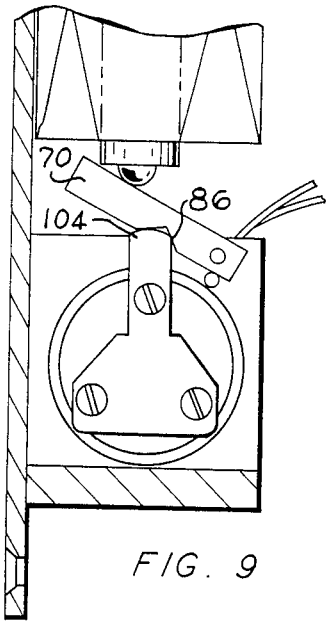
FIG. 9 is a view similar to FIG. 8, showing the deadlatch assembly in an energized position.
Figure 7:
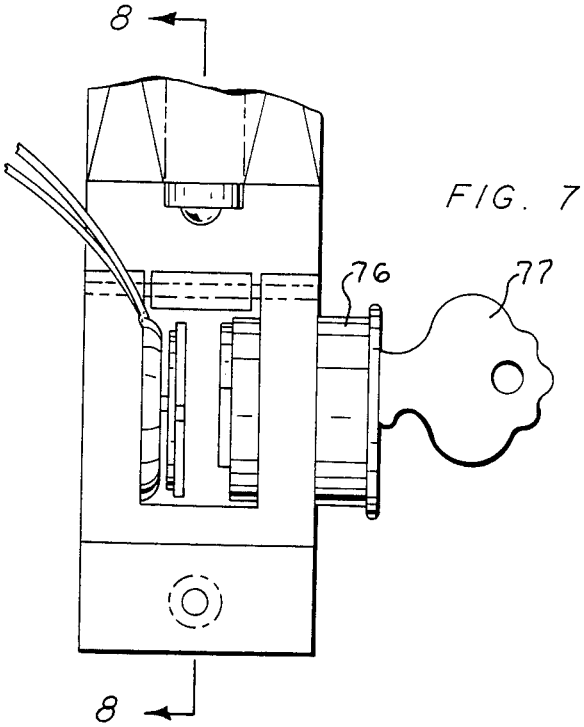
FIG. 7 is an enlarged partial rear view, partly broken away, of the lower end of the lock mechanism of FIG. 5.

Additionally, deadlatching can be selectively attained by an electrically actuated deadlatch assembly generally designated by the numeral 92 and comprising a rotary solenoid 94 having an angularly rotative armature 96 as shown in FIGS. 8 and 9. A cam 98 is mounted to the armature 96 by threaded fasteners 99 and has a cam arm 100 with an outer end 104. The outer end 104 interlockingly engages the notch 86 to provide deadlatch of bolt 20 and resist any external driving force on the bolt 20 toward the retracted position. As with the mechanical deadlatching feature, the bolt 20, the lever 36, the push rod 56, the plunger 52, the plate 70, and the cam arm 104 are in direct contact to thereby deadlatch the bolt 20 against external driving. Thus, electrically actuated deadlatching is provided in addition to manual deadlatching.

Prior to energizing the solenoid 94, it is necessary that the bolt 20 be electrically or mechanically projected into the locked position to avoid the cam arm 100 striking the plate 70. Indicator lights (not shown) provide a visual indication that the bolt 20 is in the projected position. To release the electric deadlatching feature, the solenoid 94 is de-energized and a coil spring (not shown) returns the cam 98 to its rest position as shown in FIG. 8.

In operation, the energizing of the solenoid 54 moves the bolt 20 from the retracted unlocked position to the projected locked position. After electric projection of the bolt 20, it may be deadlatched either mechanically by rotation of the cam arm 82 into interlocking engagement with the notch 86 or electrically by actuating the solenoid 94 to rotate the cam arm 104 into interlocking engagement with the notch 86. Both deadlatching features operate individually (or concurrently) to resist any external driving of the bolt 20 toward the retracted position and also operate to maintain the door lock 11 in the "locked" mode should electrical power to the solenoid 54 be interrupted or should the solenoid 54 fail.

Alternately, the bolt 20 can be projected into the locked position by manual rotation of the rotative assembly 68 either by a key 77 or a thumb turn. This provides a mechanical override of the solenoid 54 as well as mechanical deadlatching.

Accordingly, a fail-open electric door lock mechanism is provided having mechanical override, mechanical manual deadlatching and electrically actuable deadlatching. In another embodiment, a fail-secure electric door lock mechanism is provided having manual mechanical release and automatic deadlatching.

As will be apparent to persons skilled in the art, various modifications and adaptations of the structures above described will become readily apparent without departure from the spirit and scope of the invention, the scope of which is defined in the appended claims.

I claim:

1. In an electric door lock of the type having an elongated housing for mounting in a door or frame member, a bolt supported in said housing for movement between a projected locking position and a retracted non-locking position, means normally urging the bolt toward its projected position and a solenoid means for actuating the bolt to its retracted non-locking position, wherein the improvement comprises:

a crank lever pivotally mounted at one end within said housing for movement between first and second positions, said crank lever being operationally engageable with said bolt to push said bolt to said retracted position upon pivotal movement of said crank lever to said second position, said solenoid means being operationally engageable with said crank lever to pivot said crank lever to said second position upon actuation of said solenoid means, and said crank lever having a deadlatch stop portion adjacent said bolt when said bolt is in said locking position to engage and retain said bolt in a locking position to resist external driving of said bolt toward said retracted position.

2. The device of claim 1 wherein said bolt has a slot therein and said stop portion of said crank lever extends into said slot.

3. The device of claim 1 wherein, said bolt has a shank portion with a longitudinal slot therein forming a lateral edge, and said stop portion of said crank lever extends into said slot and has a first retaining surface extending into said slot and engageable with said lateral edge upon external driving of said bolt toward said retracted position.

4. The device of claim 3 wherein said stop portion has a second retaining surface outward of said slot and engageable with the exterior of said shank portion upon external driving of said bolt toward said retracted position.

5. The device of claim 4 wherein a biasing means engages said crank lever to bias said first retaining surface toward said lateral edge at least upon an external driving of said bolt toward said retracted position.

6. The device of claim 4 wherein said crank lever has first and second ends, said first end being pivotally mounted to said housing and said second end comprising said deadbolt stop portion, said first retaining surface being generally orthogonal to said second retaining surface whereby an external driving of said bolt toward said retracted position causes said lateral edge to engage said first retaining surface and pivot said second retaining surface into engagement with said shank portion to deadlatch said bolt against further movement toward said retracted position.

7. The device of claim 6 wherein a spring means for maintaining said first retaining surface adjacent said slot is interconnected to said crank lever.

8. The device of claim 3 wherein said bolt has inner and outer ends and said crank lever extends through said slot into contact with said inner end to push said bolt to said retracted position upon the pivotal movement of said crank lever to said second position.

9. The device of claim 1 wherein, said crank lever has first and second ends with said first end being pivotally mounted to said housing and said deadlatch stop portion being located at said second end, said bolt has a shank portion with a longitudinal slot therein forming a lateral edge, said second end of said crank lever extending into said slot, said deadbolt portion comprises a first retaining surface adjacent to said lateral edge when said crank lever is in said first position and a second retaining surface exterior of said shank portion and extending longitudinally therealong when said crank lever is in said first position, said first retaining surface being generally orthogonal to said second retaining surface, and a spring means is mounted to said crank element to maintain said first retaining surface adjacent said lateral edge upon an external driving force to said bolt toward said retracted position, whereby said lateral edge engages said first retaining surface to pivot said second retaining surface into engagement with said shank portion upon an external driving of said bolt toward said retracted position to deadlatch said bolt against further movement toward said retracted position.

10. An automatically deadlatching door lock comprising, an elongated housing for mounting in a door or frame member, a bolt supported in said housing for movement between a projected locking position and a retracted non-locking position, said bolt having an exterior end and an interior end, said bolt being tubular with a longitudinal slot forming a lateral edge disposed towards said exterior end, a means for normally urging said bolt toward said projected position, a crank lever having first and second ends, said first end being pivotally mounted to said housing and said second end extending into said slot, said lever being pivotally mounted to pivot between first and second positions, said second end being engageable with said interior end of said bolt to push said bolt to said retracted position upon pivotal movement of said crank lever to said second position, said second end of said crank lever having a first retaining surface adjacent said lateral edge and a second retaining surface adjacent the exterior of said bolt when said crank lever is in said first position, means for yieldably maintaining said first retaining surface adjacent said lateral edge upon external driving of said bolt toward said retracted position, and actuable means for pivoting said crank element between said first and second positions, whereby said first retaining surface engages said lateral edge and said second retaining surface engages said exterior of said bolt upon external driving of said bolt towards said retracted position to automatically deadlatch said bolt.

11. The device of claim 10 wherein said means for maintaining said first retaining surface comprises a spring connected to said crank lever to maintain said crank lever in said first position.

12. The device of claim 11 wherein said first and second retaining surfaces are generally orthogonal and form a notch in said crank lever.

13. The device of claim 11 wherein said actuable means for pivoting said crank lever comprises an electrically actuable solenoid means operationally interconnected to said crank lever.

14. The device of claim 13 wherein said means for pivoting said crank lever comprises a manually operable rotative means for pivoting said crank lever.

15. An electric door lock, comprising:

an elongated housing for mounting in a door or frame member;

a bolt slidably mounted in said housing for movement between a first position and a second position, said first position being a projected, locking position and said second position being a retracted, non-locking position;

means normally urging said bolt towards one of said first and second positions;

a solenoid means for electrically actuating said bolt to the other of said first and second positions, said solenoid means having a plunger element movable from a first position to a second position;

means for operatively connecting said plunger element to said bolt to move said bolt to said other of said first and second positions by movement of said plunger element to said second position;

said plunger element of said solenoid means having an upper end operationally connected to said connecting means and a lower end; and manually operative rotative means for mechanically moving said plunger element to said second position comprising a cam element rotatably mounted within said housing and means for manually rotating said cam element disposed exterior of said housing, said cam element operationally engaging said lower end of said plunger element upon angular rotation to move said plunger element to said second position.

16. The device of claim 15 wherein, a lever arm is pivotally mounted within said housing interposed between said lower end of said plunger and said cam element, and said cam element has a cam arm to drive said lever arm into engagement with said lower end of said plunger to move said plunger to said second position.

17. The device of claim 16 wherein said lever arm has a notch therein and said cam arm has an edge portion adapted to interlockingly engage said notch, said edge portion interlockingly engaging said notch when said plunger element is moved to said second position by said lever arm and being disengageable from said notch by reverse rotation of said cam element.

18. The device of claim 17 wherein, said means for normally urging said bolt comprises a spring biasing said bolt towards said retracted non-locking position;

said connecting means comprises a bellcrank having one end portion pivotally mounted to said housing and the other end portion engageable with said bolt so that movement of said plunger element to said second position pivots said bellcrank to project said bolt to the locking position, and said edge portion of said cam arm interlockingly engages said notch to deadlatch said bolt in said protracted position to resist external driving of said bolt toward said retracted position independent of whether said solenoid means is electrically actuated.

19. The device of claim 17 wherein, said means for normally urging said bolt comprises a spring biasing said bolt towards said retracted non-locking position, said connecting means comprises a bellcrank having one end portion pivotally mounted to said housing and the other end portion engageable with said bolt so that movement of said plunger element to said second position pivots said bellcrank to project said bolt to the locking position, a second solenoid means having an arm member with an edge portion adapted to interlockingly engage said notch, said arm being electrically actuable to an actuated position, said edge portion interlockingly engaging said notch when said arm member is in said actuated position to deadlatch said bolt in said protracted position to resist external driving of said bolt toward said retracted position independent of whether said bolt actuating solenoid means is electrically actuated.

20. An electric door lock, comprising:

an elongated housing for mounting in a door or frame member;

a bolt slidably mounted in said housing for movement between a first position and a second position, said first position being a projected, locking position and said second position being a retracted, non-locking position;

a spring biasing said bolt towards said first position;

a solenoid means for electrically actuating said bolt to said second position, said solenoid means having a plunger element movable from a first position to a second position;

means for operatively connecting said plunger element to said bolt to move said bolt to said second position by movement of said plunger element to said second position; and manually operative rotative means for mechanically moving said plunger element to said second position, said connecting means comprising a bellcrank having one end portion pivotally mounted to said housing and the other end portion engaging said bolt so that movement of said plunger element to said second position pivots said bellcrank to retract said bolt to said non-locking position;

whereby manual rotation of said moving means moves said bolt to the non-locking position and, alternately, actuation of said solenoid means moves said bolt to the non-locking position.

21. An electric door lock, comprising:

an elongated housing for mounting in a door or frame member;

a bolt slidably mounted in said housing for movement between a first position and a second position, said first position being a projected, locking position and said second position being a retracted, non-locking position;

a spring biasing said bolt towards said second position;

a solenoid means for electrically actuating said bolt to the said first position, said solenoid means having a plunger element movable from a first position to a second position;

means for operatively connecting said plunger element to said bolt to move said bolt to said first position by movement of said plunger element to said second position; and manually operative rotative means for mechanically moving said plunger element to said second position;

said connecting means comprising a bellcrank having one end portion pivotally mounted to said housing and the other end portion engaging said bolt so that movement of said plunger element to said second position pivots said bellcrank to project said bolt to the locking position; and whereby manual rotation of said moving means moves said bolt to the locking position and, alternatively, actuation of said solenoid means moves said bolt to the locking position.

22. An electric door lock, comprising:

an elongated housing for mounting in a door or frame member;

a bolt slidably mounted in said housing for movement between a first position and a second position, said first position being a projected, locking position and said second position being a retracted, non-locking position;

means normally urging said bolt towards one of said first and second positions;

a first solenoid means for electrically actuating said bolt to the other of said first and second positions, said solenoid means having a plunger element movable from a first position to a second position;

means for operatively connecting said plunger element to said bolt to move said bolt to said other of said first and second positions by movement of said plunger element to said second position;

manually operative rotative means for mechanically moving said plunger element to said second position; and a second solenoid means for deadlatching said bolt in said protracted position to resist external driving of said bolt toward said retracted position independently of whether the first solenoid means remains electrically actuated.

23. The device of claim 22 wherein, said means for normally urging said bolt comprises a spring biasing said bolt towards said retracted non-locking position, said connecting means comprises a bellcrank having one end portion pivotally mounted to said housing and the other end portion engageable with said bolt, said plunger element having a lower end and an upper end engageable with said bellcrank so that movement of said plunger element to said second position pivots said bellcrank to project said bolt to the locking position, a lever arm is pivotally mounted within said housing adjacent said lower end of said plunger, said lever arm having a notch therein, and said second solenoid means comprises an arm member electrically actuable to an actuated position, said arm member having an edge portion adapted to interlockingly engage said notch when said arm member is in said actuated position to deadlatch said bolt.

* * * * *